US010401134B2

(12) United States Patent
Trouillot et al.

(10) Patent No.: US 10,401,134 B2
(45) Date of Patent: Sep. 3, 2019

(54) ARTILLERY PROJECTILE WITH A PILOTED PHASE

(71) Applicant: NEXTER MUNITIONS, Versailles (FR)

(72) Inventors: Christian Trouillot, Bourges (FR); Geoffroy Deschatre, Bourges (FR)

(73) Assignee: NEXTER MUNITIONS, Versailles (FR)

( * ) Notice: Subject to any disclaimer, the term of this patent is extended or adjusted under 35 U.S.C. 154(b) by 267 days.

(21) Appl. No.: 15/278,653

(22) Filed: Sep. 28, 2016

(65) Prior Publication Data

US 2017/0299355 A1 Oct. 19, 2017

(30) Foreign Application Priority Data

Sep. 29, 2015 (FR) ..... 15 02030

(51) Int. Cl.
*F42B 10/14* (2006.01)
*F42B 12/20* (2006.01)
*F42B 14/06* (2006.01)

(52) U.S. Cl.
CPC ..... *F42B 10/14* (2013.01); *F42B 12/20* (2013.01); *F42B 14/064* (2013.01)

(58) Field of Classification Search
CPC ..... F42B 10/64; F42B 10/14; F42B 15/01; F42B 10/30; F42B 10/16; F42B 15/00; F42B 10/26; F42B 10/50; F42B 10/62; F42B 12/06; F42B 10/04; F41G 7/2293
See application file for complete search history.

(56) References Cited

U.S. PATENT DOCUMENTS 2,421,752 A * 6/1947 Jones ..... F42B 12/68 102/222
2,644,364 A * 7/1953 Nass ..... F42B 5/10 102/376
2,801,586 A * 8/1957 Mongello ..... F41A 33/00 102/372
2,955,777 A * 10/1960 Null ..... F41G 7/2206 244/3.14

(Continued)

FOREIGN PATENT DOCUMENTS

EP 0905473 A1 3/1999

OTHER PUBLICATIONS

May 18, 2016 Preliminary Search Report issued in French Patent Application No. 1502030.

(Continued)

*Primary Examiner* — Medhat Badawi
(74) *Attorney, Agent, or Firm* — Oliff PLC

(57) ABSTRACT

The invention relates to an artillery projectile (1) which is intended to have a trajectory comprising a ballistic phase and a piloted phase. This projectile (1) has at least one means ensuring its aerodynamic stabilization on part or all of its trajectory and a means (9) intended to ensure a piloting during the piloted phase. This projectile is characterized in that the aerodynamic stabilization means comprises a wing system having at least two wings (16) which are able to positioned with respect to the axis (26) of the projectile, at least during the piloted phase, with their sweepback angles being negative, that is, with the free ends (**16*b*) of the wings (16) being oriented towards the front of the projectile (1**).

8 Claims, 10 Drawing Sheets

(56) References Cited

U.S. PATENT DOCUMENTS 3,218,005 A * 11/1965 Calderon ..... B64C 3/42 244/218
3,392,934 A * 7/1968 Daniels ..... F42B 10/06 102/385
3,510,096 A * 5/1970 Bauman et al. ..... F42B 10/30 244/3.23
3,588,004 A * 6/1971 Suter ..... F42B 10/14 244/3.27
3,635,404 A * 1/1972 Hopkins ..... F02K 9/974 239/265.15
3,708,139 A * 1/1973 Wheeler ..... F42B 10/64 244/3.13
3,964,696 A * 6/1976 Orzechowski ..... F42B 10/16 244/3.23
3,976,266 A * 8/1976 Fieuzal ..... F42B 10/64 244/3.21
4,054,254 A * 10/1977 Cole ..... G05D 1/108 244/3.21
4,076,187 A * 2/1978 Metz ..... F42B 10/64 244/3.23
4,099,683 A * 7/1978 Stouffer ..... B60R 22/44 242/375.3
4,203,569 A * 5/1980 Marks ..... F02K 9/978 244/3.23
4,296,895 A * 10/1981 Pazmany ..... F42B 10/64 102/388
4,410,151 A * 10/1983 Hoppner ..... B64C 39/024 244/120
4,434,718 A * 3/1984 Kopsch ..... F42B 14/064 102/439
4,460,137 A * 7/1984 Andersson ..... F42B 10/16 244/3.27
4,558,325 A * 12/1985 Stro/ m ..... F16C 11/06 244/3.16
4,607,810 A * 8/1986 Frazer ..... F42B 10/16 206/497
4,745,861 A * 5/1988 Fenton ..... F02K 9/30 102/377
4,778,127 A * 10/1988 Duchesneau ..... F42B 10/16 188/284
4,817,891 A * 4/1989 Gaywood ..... F42B 10/16 244/3.23
4,903,917 A * 2/1990 Peller ..... B64C 23/08 244/21
4,913,379 A * 4/1990 Kubota ..... F42B 10/60 239/265.35
4,949,917 A * 8/1990 Cottle, Jr. ..... F41G 7/2213 244/3.16
4,964,593 A * 10/1990 Kranz ..... F42B 10/64 102/208
5,048,773 A * 9/1991 Washington ..... F42B 10/143 102/386
5,141,175 A * 8/1992 Harris ..... F42B 10/14 102/384
5,154,370 A * 10/1992 Cox ..... F42B 10/14 244/16
5,181,675 A * 1/1993 Lardellier ..... B64D 27/18 244/54
5,189,250 A * 2/1993 Shaphyr ..... F42B 10/16 102/247
5,322,243 A * 6/1994 Stoy ..... B64C 5/10 244/3.24
5,326,049 A * 7/1994 Rom ..... F42B 10/14 102/388
5,340,056 A * 8/1994 Guelman ..... F41G 7/007 244/3.16
5,347,910 A * 9/1994 Avila ..... F41G 3/165 235/411
5,379,968 A * 1/1995 Grosso ..... F42B 10/661 244/3.21
5,393,011 A * 2/1995 Dunn ..... F42B 10/64 244/3.21
5,393,012 A * 2/1995 Dunn ..... F42B 10/54 244/3.21
5,417,393 A * 5/1995 Klestadt ..... F42B 10/146 244/3.21
5,423,497 A * 6/1995 Ransom ..... F42B 10/62 244/3.21
5,452,864 A * 9/1995 Alford ..... F42B 10/26 244/3.23
5,476,045 A * 12/1995 Chung ..... F42B 10/48 102/517
5,780,766 A * 7/1998 Schroppel ..... F42B 12/16 102/308
5,806,791 A * 9/1998 Hatalsky ..... F02K 9/805 244/3.24
5,829,715 A * 11/1998 Banks ..... F42B 10/14 244/49
5,899,410 A * 5/1999 Garrett ..... B64C 39/068 244/45 R
6,073,880 A * 6/2000 Voigt ..... F42B 10/14 244/3.24
6,186,442 B1 * 2/2001 Bittle ..... F42B 10/16 244/3.29
6,234,082 B1 * 5/2001 Cros ..... F42B 14/02 102/520
6,247,666 B1 * 6/2001 Baker ..... B63B 39/06 244/3.15
6,408,762 B1 * 6/2002 Schmacker ..... F42B 12/06 102/382
6,435,097 B1 * 8/2002 Garner ..... F42B 10/16 102/490
6,557,798 B1 * 5/2003 Giesenberg ..... F42B 10/16 244/3.27
6,571,715 B1 * 6/2003 Bennett ..... F42B 10/38 102/374
6,601,795 B1 * 8/2003 Chen ..... B64C 3/40 244/46
RE38,261 E * 10/2003 White ..... F42B 10/22 102/529
6,644,358 B2 * 11/2003 Demarest ..... B22D 13/02 138/121
6,644,587 B2 * 11/2003 Kusic ..... B64C 5/04 244/3.24
6,672,537 B1 * 1/2004 Deckard ..... F42B 10/16 244/3.24
6,695,252 B1 * 2/2004 Dryer ..... F42B 10/14 244/3.28
6,739,548 B1 * 5/2004 Bittle ..... F42B 10/16 244/3.29
6,832,740 B1 * 12/2004 Ransom ..... F41G 7/2233 102/489
6,834,828 B1 * 12/2004 Tritt ..... F42B 10/14 102/384
6,869,044 B2 * 3/2005 Geswender ..... F42B 10/06 244/3.1
6,880,780 B1 * 4/2005 Perry ..... F42B 10/14 244/3.27
6,923,404 B1 * 8/2005 Liu ..... B64C 3/40 244/46
7,004,425 B2 * 2/2006 Okada ..... F42B 10/16 244/3.29
7,097,132 B2 * 8/2006 Banks ..... F42B 10/14 244/3.27
7,105,790 B2 * 9/2006 Lamorlette ..... F41G 7/346 244/3.1
7,165,742 B2 * 1/2007 Kusic ..... B64C 5/04 244/3.1
7,246,539 B2 * 7/2007 Turner ..... F42B 10/64 244/225
7,267,298 B2 * 9/2007 Leininger ..... F42B 10/64 102/490
7,526,988 B2 * 5/2009 Elder ..... F41B 6/006 102/514
7,849,800 B2 * 12/2010 Hinsdale ..... F42B 10/14 102/473
7,906,749 B2 * 3/2011 Fjerstad ..... B64C 13/28 244/3.1

(56) References Cited

U.S. PATENT DOCUMENTS 7,926,408 B1 * 4/2011 Kley ..... F41A 33/02 124/73
D637,262 S * 5/2011 Alculumbre ..... D22/116
8,026,465 B1 * 9/2011 Fraysse, Jr. ..... F42B 10/50 244/3.22
8,237,096 B1 * 8/2012 Alexander ..... F42B 10/64 102/384
8,350,200 B1 * 1/2013 Hawkins ..... F42B 15/01 244/3.24
8,350,201 B2 * 1/2013 Bastian ..... F02K 9/84 244/3.15
8,436,285 B2 * 5/2013 Corradini ..... F42B 10/64 244/3.21
8,525,089 B2 * 9/2013 Shin ..... F42B 10/16 244/3.24
8,544,790 B2 * 10/2013 Afanasyev ..... B64C 3/56 244/3.29
8,624,172 B2 * 1/2014 Sweer ..... F42B 10/64 244/3.21
8,698,059 B2 * 4/2014 Nikkel ..... F42B 10/16 244/3.27
8,714,476 B2 * 5/2014 Reany ..... B64C 3/56 244/123.1
8,816,261 B1 * 8/2014 Blake ..... F42B 10/62 102/501
8,829,401 B1 * 9/2014 Lutke ..... F41F 3/065 102/501
8,890,043 B2 * 11/2014 Cohe ..... F42B 10/64 244/3.24
8,894,004 B1 * 11/2014 Scott ..... F42B 10/14 244/3.27
9,019,375 B1 * 4/2015 Whelan ..... G01C 23/00 348/117
9,541,361 B2 * 1/2017 Bae ..... F42B 10/64
9,989,338 B2 * 6/2018 Osdon ..... F42B 10/16
2003/0037665 A1 * 2/2003 Rupert ..... F42B 10/50 89/1.8
2003/0041767 A1 * 3/2003 Rastegar ..... F41H 11/02 102/207
2003/0089820 A1 * 5/2003 Martorana ..... B64C 39/024 244/3.1
2003/0146342 A1 * 8/2003 Hellman ..... F42B 10/20 244/3.27
2004/0011920 A1 * 1/2004 Johnsson ..... F42B 10/14 244/3.29
2004/0144888 A1 * 7/2004 Dryer ..... F42B 10/14 244/3.27
2004/0164202 A1 * 8/2004 Klestadt ..... F42B 10/54 244/3.24
2004/0217227 A1 * 11/2004 Alculumbre ..... F42B 10/16 244/3.28
2005/0056723 A1 * 3/2005 Clancy ..... F42B 10/04 244/3.24
2005/0116090 A1 * 6/2005 Welty ..... F42B 12/74 244/13
2005/0236514 A1 * 10/2005 Lawless ..... B64C 5/12 244/3.27
2005/0258310 A1 * 11/2005 Bilyk ..... B63B 22/003 244/138 R
2006/0011090 A1 * 1/2006 Vasel ..... F41B 11/62 102/512
2006/0065775 A1 * 3/2006 Smith ..... F42B 10/26 244/3.23
2007/0007383 A1 * 1/2007 Hsu ..... F42B 10/64 244/3.24
2007/0018033 A1 * 1/2007 Fanucci ..... F42B 10/143 244/3.27
2007/0045466 A1 * 3/2007 Hellis ..... F42B 10/14 244/3.29
2008/0001023 A1 * 1/2008 Schroeder ..... F42B 10/14 244/3.24
2008/0029641 A1 * 2/2008 Carlson ..... F42B 10/64 244/3.24
2008/0061188 A1 * 3/2008 Morris ..... F42B 10/54 244/3.23
2008/0111020 A1 * 5/2008 Peterson ..... F42B 10/14 244/3.28
2008/0237391 A1 * 10/2008 Mock ..... F42B 10/26 244/3.1
2008/0302906 A1 * 12/2008 Bar ..... F42B 10/64 244/3.22
2008/0315032 A1 * 12/2008 Hamoy ..... F24B 10/26 244/3.23
2009/0072094 A1 * 3/2009 Sanderson ..... B63G 8/26 244/218
2009/0090809 A1 * 4/2009 Ronn ..... F24B 10/14 244/3.28
2009/0272840 A1 * 11/2009 Dietrich ..... B64C 1/32 244/16
2010/0001117 A1 * 1/2010 Kusic ..... B64C 5/04 244/3.1
2010/0102161 A1 * 4/2010 Geswender ..... F42B 10/16 244/3.27
2010/0147992 A1 * 6/2010 Mock ..... F42B 10/62 244/3.22
2010/0175546 A1 * 7/2010 Crawford ..... F42B 10/50 89/1.14
2010/0198514 A1 * 8/2010 Miralles ..... F41G 7/008 701/302
2010/0237185 A1 * 9/2010 Dryer ..... F42B 10/26 244/3.22
2010/0264260 A1 * 10/2010 Hammerquist ..... B64C 3/56 244/49
2010/0282895 A1 * 11/2010 Geswender ..... F42B 10/14 244/3.29
2010/0288870 A1 * 11/2010 Geswender ..... F42B 10/16 244/3.27
2010/0308153 A1 * 12/2010 Cohe ..... F42B 10/18 244/3.27
2010/0314488 A1 * 12/2010 Ashkenazi ..... F42B 10/16 244/3.27
2010/0320312 A1 * 12/2010 Bril ..... F41G 7/008 244/3.16
2010/0326309 A1 * 12/2010 Nurminen ..... F41A 9/58 102/473
2011/0024550 A1 * 2/2011 McDermott ..... F42B 10/44 244/3.27
2011/0226174 A1 * 9/2011 Parks ..... B60F 5/02 114/313
2012/0017795 A1 * 1/2012 Dryer ..... F42B 10/16 102/526
2012/0018572 A1 * 1/2012 Shai ..... F42B 10/14 244/39
2012/0025009 A1 * 2/2012 Geswender ..... F42B 10/16 244/3.27
2012/0048992 A1 * 3/2012 Malul ..... F42B 10/64 244/3.24
2012/0048993 A1 * 3/2012 Velez ..... F42B 10/16 244/3.28
2012/0068002 A1 * 3/2012 Unger ..... F42B 10/14 244/3.28
2012/0091256 A1 * 4/2012 Alculumbre ..... F42B 10/16 244/3.29
2012/0199691 A1 * 8/2012 Geswender ..... F42B 10/16 244/3.21
2013/0041527 A1 * 2/2013 Sowers ..... F42B 10/64 701/3
2013/0056578 A1 * 3/2013 Alculumbre ..... F42B 10/16 244/3.29
2013/0099049 A1 * 4/2013 Reany ..... B64C 3/56 244/46
2014/0061346 A1 * 3/2014 Rose ..... A47J 43/288 241/101.8
2014/0172200 A1 * 6/2014 Miralles ..... G05D 1/12 701/3
2014/0209732 A1 * 7/2014 Pettersson ..... F42B 10/14 244/3.23

(56) References Cited

U.S. PATENT DOCUMENTS

| | | | | |
|---|---|---|---|---|
| 2014/0231577 | A1* | 8/2014 | Roy | F42B 10/62<br>244/3.24 |
| 2016/0185445 | A1* | 6/2016 | Miralles | B64C 3/44<br>244/13 |
| 2017/0299355 | A1* | 10/2017 | Trouillot | F42B 10/14 |

OTHER PUBLICATIONS

May 18, 2016 Written Opinion issued in French Patent Application No. 1502030.

* cited by examiner

ARTILLERY PROJECTILE WITH A PILOTED PHASE

The technical field of the invention is that of artillery projectiles intended to have a trajectory comprising a ballistic initial phase and a piloted phase.

The aim today is to provide artillery projectiles (or shells) having an extended range and being able to be piloted for controlling their trajectory, searching and reaching a particular target.

The piloting means most often have canard controls which are provided at a front part of the projectile and are controlled by motor-reduction units (individually or on a plane by plane basis). The front part of the projectile incorporates a homing device and a computer allowing to guide and pilot the projectile towards a particular target the signature characteristics of which will have been stored in the computer. A satellite positioning system can also be implemented in the projectile flight control chain.

These projectiles can have a significant range at a lower cost due to the firing by an artillery gun which allows to get a shell of 45 kg at an altitude higher than 10 km within one minute of flight.

This type of projectile completes the range of shells which can be implemented by a same artillery system. The versatility of a weapon system responds to a recurrent operational need of the forces.

Further, the ballistic firing by a gun allows to obtain a relative accuracy for the positioning of the projectile with respect to an area (or firing window) where potential targets are located.

With the same accuracy, the artillery projectiles thus have a cost lower than that of missiles which must be piloted on their entire trajectory and which must carry a propelling charge.

One of the characteristics of the conventional artillery projectiles is that they are gyroscopically stabilized, the rotation being transmitted by the barrel grooves during the ballistic movement. This stabilization mode becomes a disadvantage for the artillery projectiles having a ballistic phase and a piloted phase because they must have a reduced rotation speed so as not to mechanically stress too much the sensors and the guiding/piloting electronics.

It is thus known, for example by patent EP905473, to provide an artillery shell carrying at its rear part a folding stabilizing tail assembly.

A rear sabot holds the fins of the tail assembly folded within the barrel of the weapon. It carries a sliding band which allows to communicate to the shell only a reduced rotation speed, in the order of a few tenths of revolutions per second (the usual rotation of a shell of 155 mm without sliding band is in the order of 300 revolutions/second).

When exiting the barrel, the sabot is ejected either by the effect of a propellant gas action within the tube, or by the effect of the aerodynamic flow applying thereto when exiting the barrel, the sabot could, for example, carry longitudinal weakened portions causing a cutout in a petal shape when exiting the weapon barrel and the sabot is ejected.

The projectile is thus aerostabilized during ballistic phase.

The stabilization in supersonic flight requires a static margin (distance between the aerodynamic center and the center of gravity) of the order of −1 caliber. The rear tail assembly further ensures a complementary rotation braking of the projectile. It potentially allows to control the residual rotation speed which can be imposed by the type of on-board sensors and the piloting algorithms.

When the projectile reaches the peak of its trajectory (which can be at an altitude higher than 10 km for long range firing), it initiates its descent to the area where potential targets are located.

Generally, piloting towards the target is ensured by canard controls provided at a front part of the projectile, as described by patent EP0905473.

One of the problems encountered is that the stabilization ensured by the tail assembly is not optimum for piloted steered flight and reduces the trajectory correction performances which are allowed by the canards.

Is also known by U.S. Pat. No. 8,894,004 a wing deployment mechanism for a projectile in which the wings are arranged in folded position with their plans parallel to the projectile axis. However, when these wings are in deployed position, they are oriented in a highly stabilizing manner, which still reduces the correction performances of the canards, if they are present. In fact, the wings described by this patent ensure themselves a trajectory correction function by having a capacity to pivot with respect to their main axis, perpendicular to the projectile axis.

The invention aims to provide an artillery projectile architecture in which the aerodynamic stabilization ensured by the tail assembly in ballistic phase does not reduce the performances of the piloting means in piloted phase.

According to a particular embodiment, a same tilt wing system can besides ensure the aerodynamic stabilization in ballistic phase by generating a stabilizing longitudinal moment (static margin of the order of −1 cal) and can also ensure the maneuverability in piloted phase (by generating lift with a static margin of the order of −0.25 cal).

The invention can thus decorrelate the static stability and the lift depending on the flight regimes.

The invention thus allows to optimize the definition of the piloting module, particularly the sizes and the selection of components such as the engines, hence the cost of the projectile.

The invention thus relates to an artillery projectile intended to have a trajectory comprising a ballistic phase and a piloted phase, the projectile having at least one means ensuring its aerodynamic stabilization on part or all of its trajectory and a means intended to ensure a piloting during the piloted phase, the projectile being characterized in that the aerodynamic stabilization means comprises a wing system having at least two wings which are able to be positioned with respect to the axis of the projectile, at least during the piloted phase, with their sweepback angles being negative, that is, with the free ends of the wings being oriented towards the front of the projectile.

According to a first embodiment, the wings of the wing system could deploy during a first part of the ballistic trajectory so as to have positive sweepback angles, a maneuvering means being provided for allowing to change the sweepback angle of the wings and to make it have negative values during a second part of the ballistic trajectory.

Each wing could be connected to a housing with respect to which it is mounted in a tilting manner via a wing support, the wing being connected to the support by a rod having means allowing it to pivot with respect to the wing support during the tilting movement of the support with respect to the housing, the wing thus switching from a folded position, in which it is positioned along the projectile with the plane of the wing applied along an outer wall of the projectile, to a deployed position in which the plane of the wing is radially oriented with respect to the projectile, each housing further being pivotably mounted with respect to the projectile body and the maneuvering means allowing to pivot all the housings carrying the wings so as to change simultaneously the sweepback angle of all the wings.

The maneuvering means could have a piston having the same axis as the projectile axis, the piston will comprise a rear face which will bear against a lower face of the housings, the piston being able to translate by the action of a motor means, the translation of the piston causing all the housings to pivot simultaneously.

Advantageously, the piston could assume a final position at the end of the translation, in which it ensures a locking of all the housings in the position with a negative sweepback angle.

The housings of the wings and the maneuvering means could be accommodated within a rear base integral with the projectile body.

The projectile could comprise a sabot surrounding the base and covering the wings in their folded position, the sabot carrying a sliding band and being ejected after firing.

Each wing could be engaged in a notch of the projectile body when it is in its final position with a negative sweepback angle.

According to another embodiment of the invention, the aerodynamic stabilization means could also have a folding tail assembly which will be provided at a rear part of the projectile, the tail assembly being deployed during the ballistic phase.

According to a particular embodiment, the tail assembly could be attached to the projectile by a releasable connecting means, the tail assembly being ejected before opening the wing system with negative sweepback angles.

The invention will be better understood upon reading the following description of different embodiments, description made with reference to the appended drawings in which.

Figure 5A:
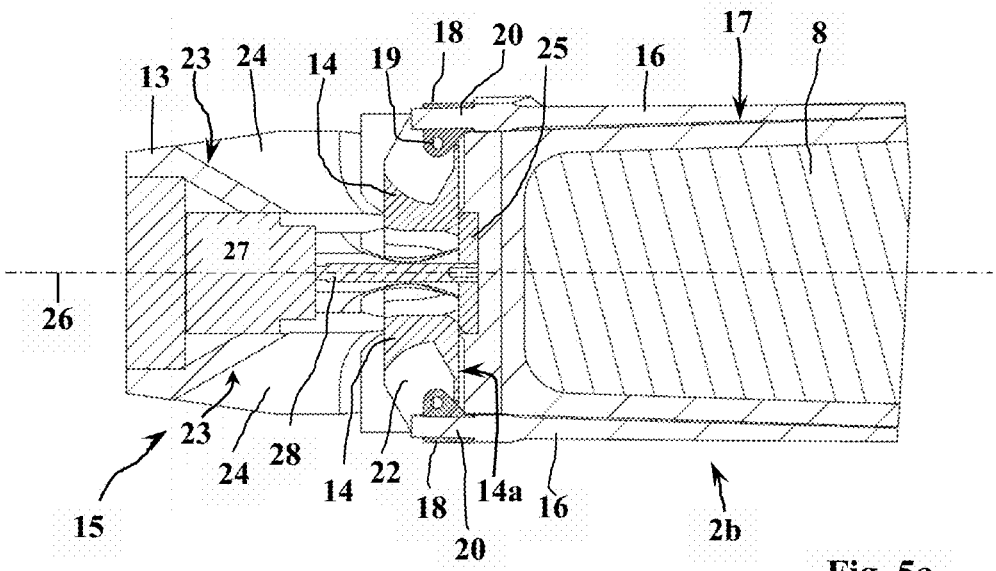
Figure 5B:
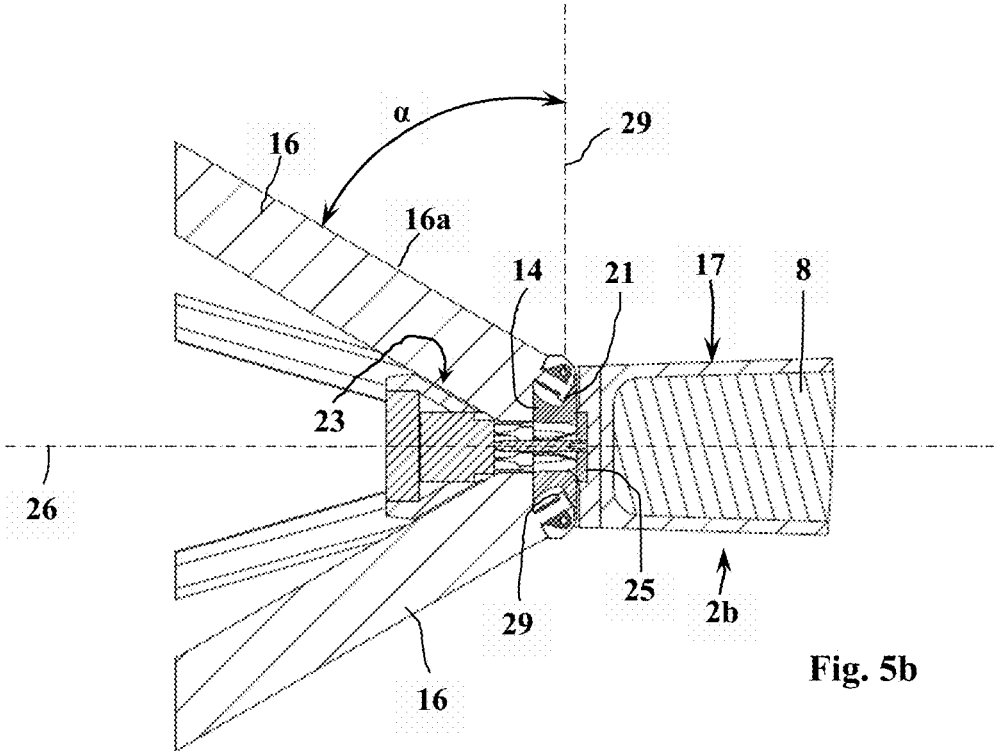
Figure 5C:
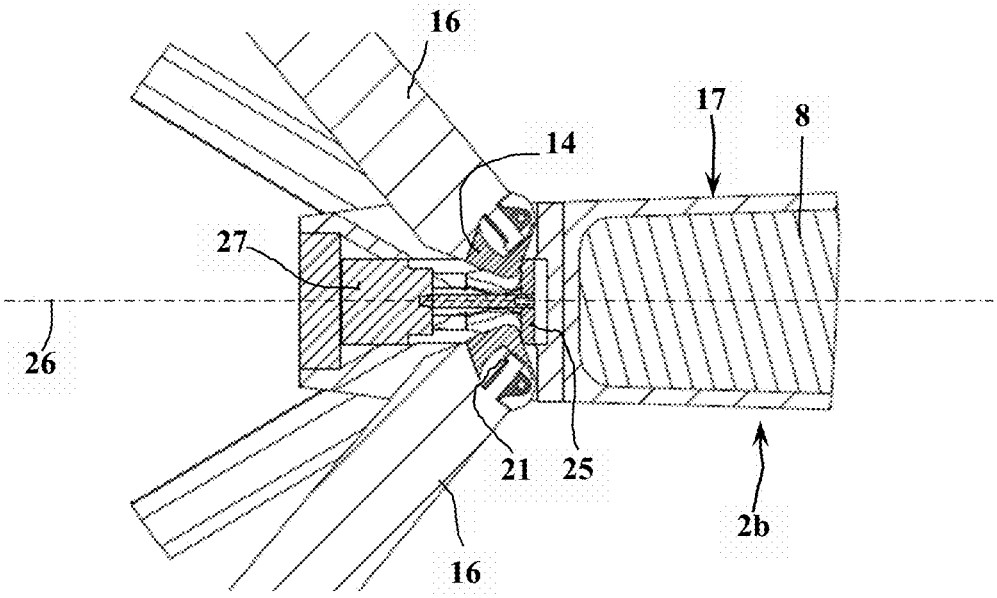
Figure 5D:
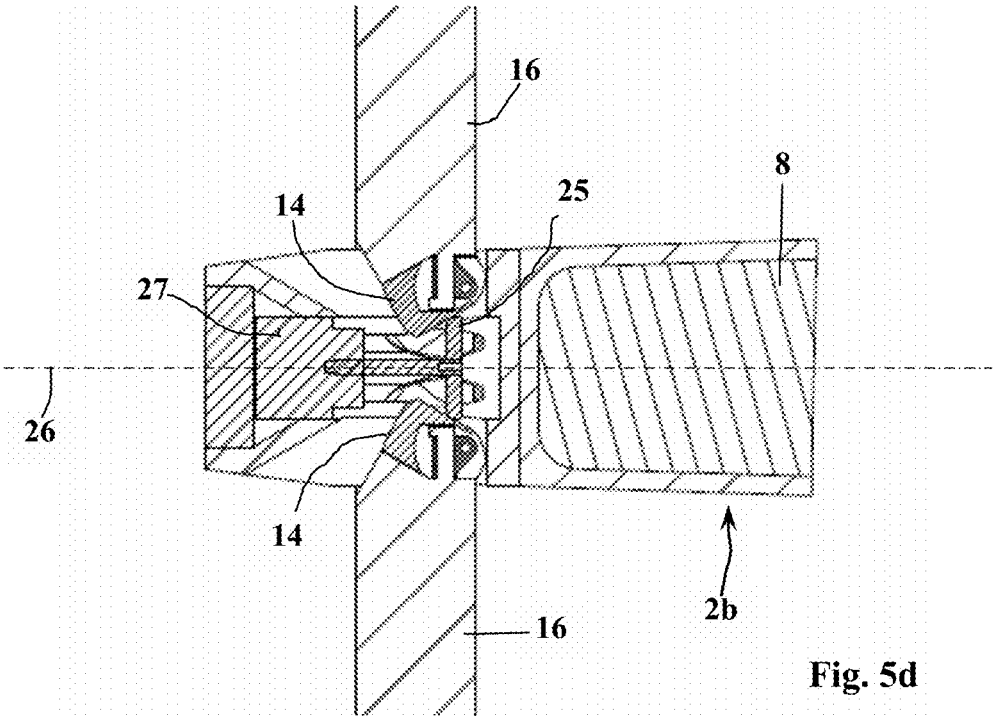
Figure 5E:
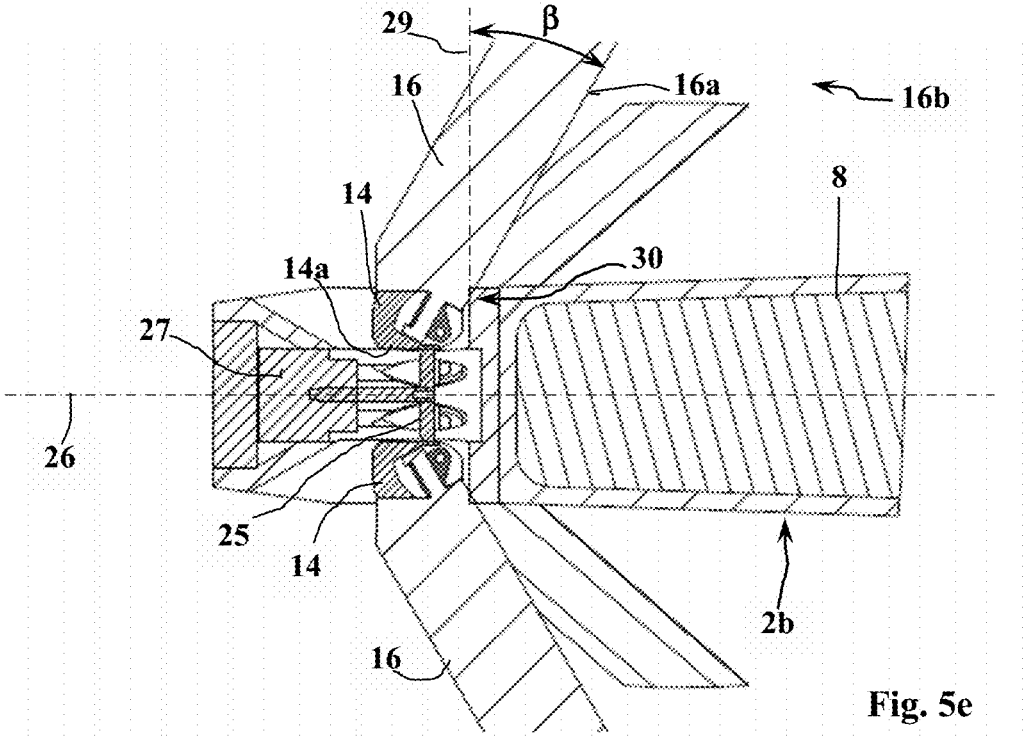
Figure 5F:
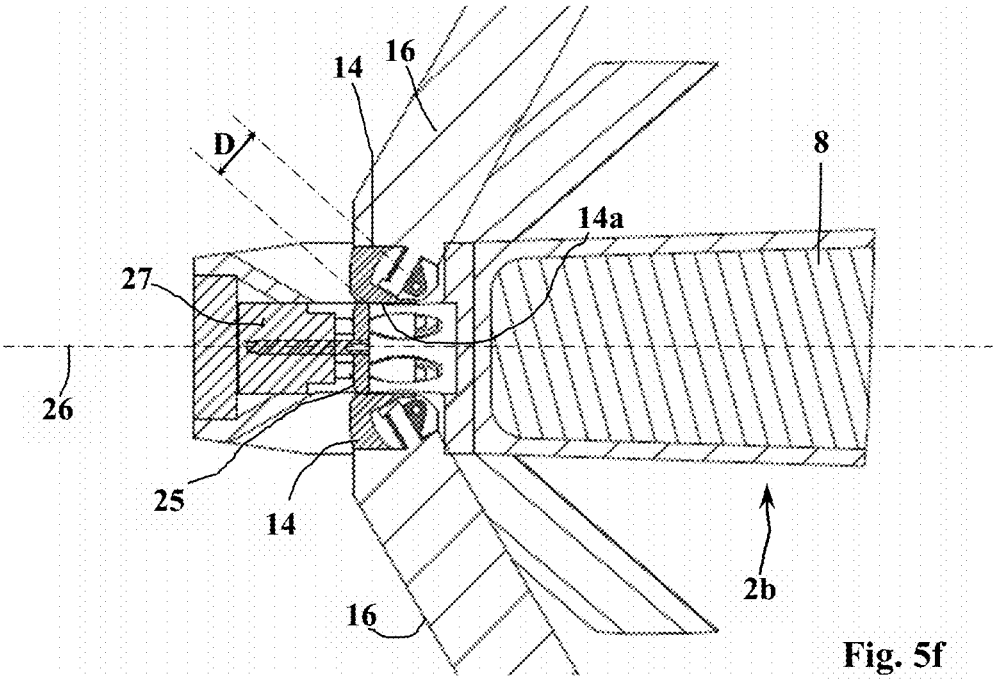
Figure 6A:
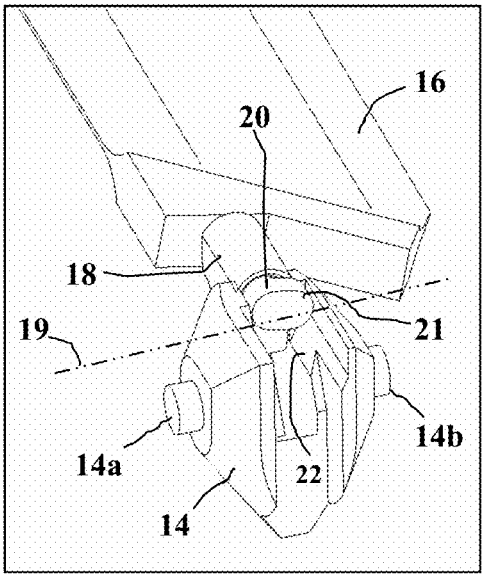
Figure 6B:
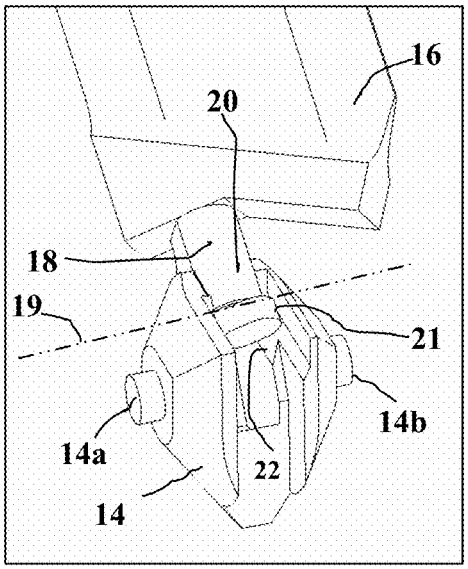
Figure 7A:
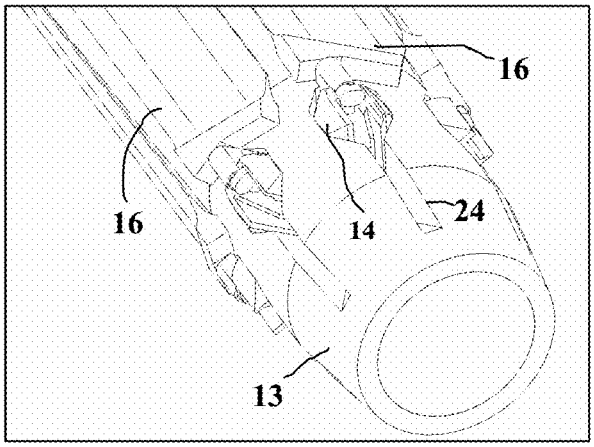
Figure 7B:
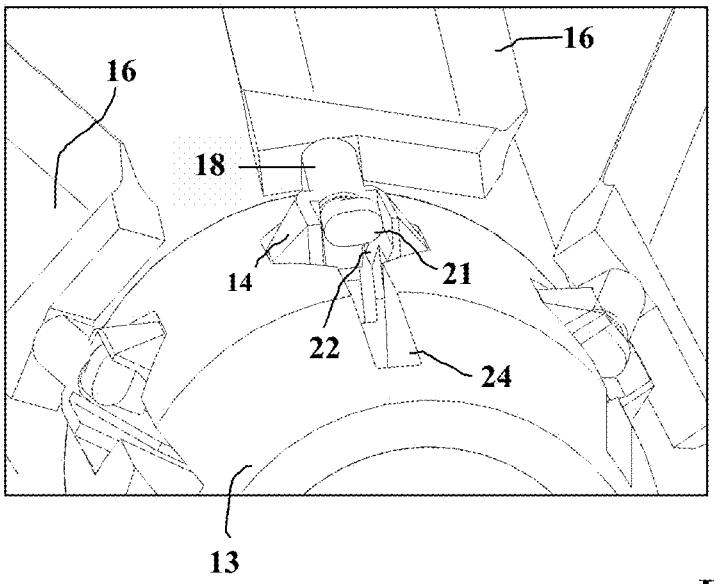
Figure 7C:
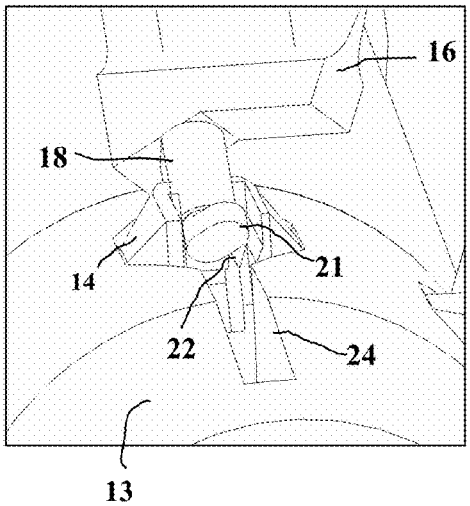
Figure 7D:
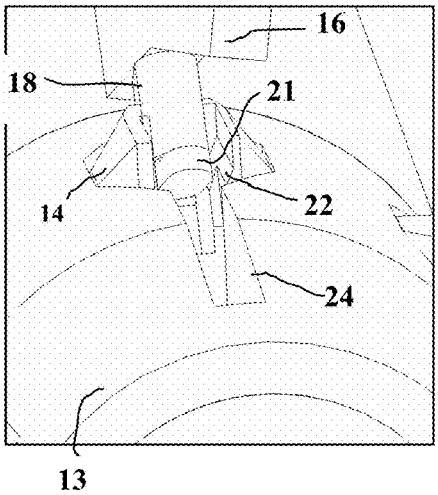
Figure 7E:
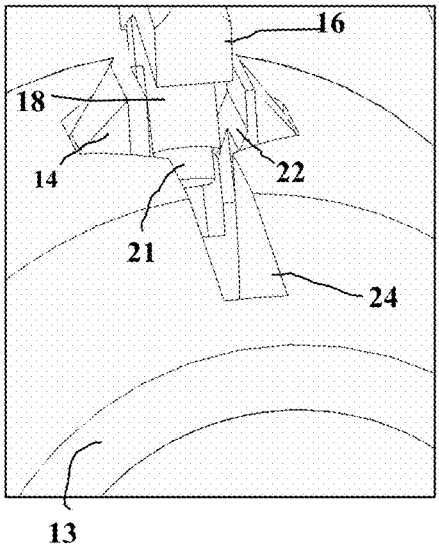
Figure 7F:
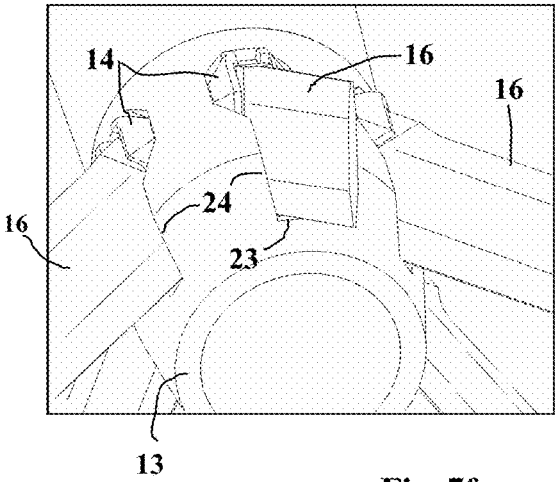
Figure 8:
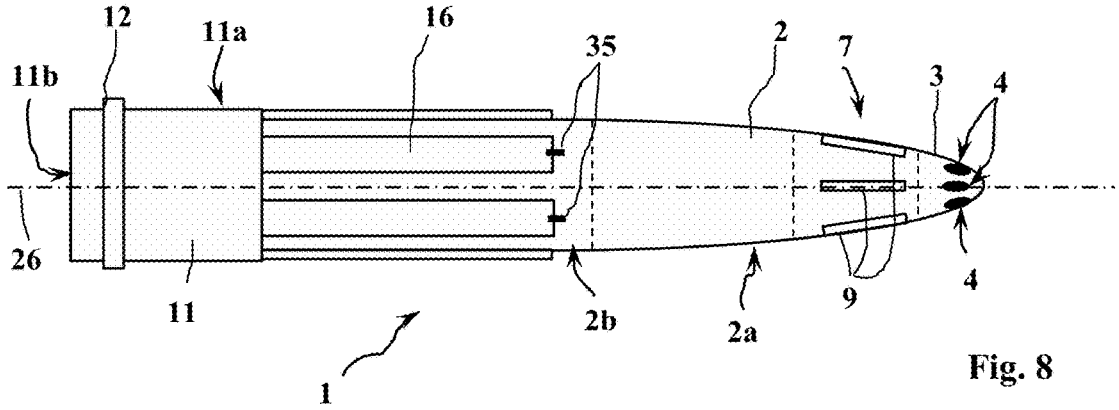
Figure 9:
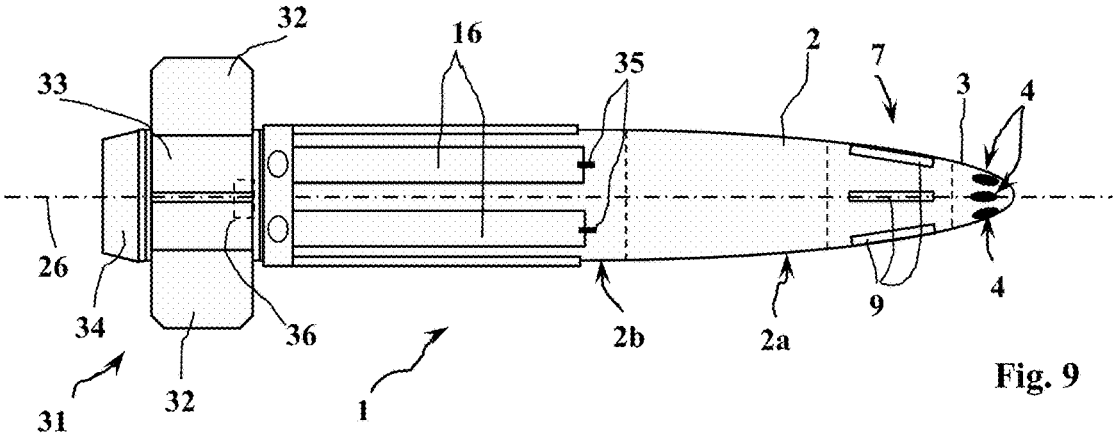
Figure 10:
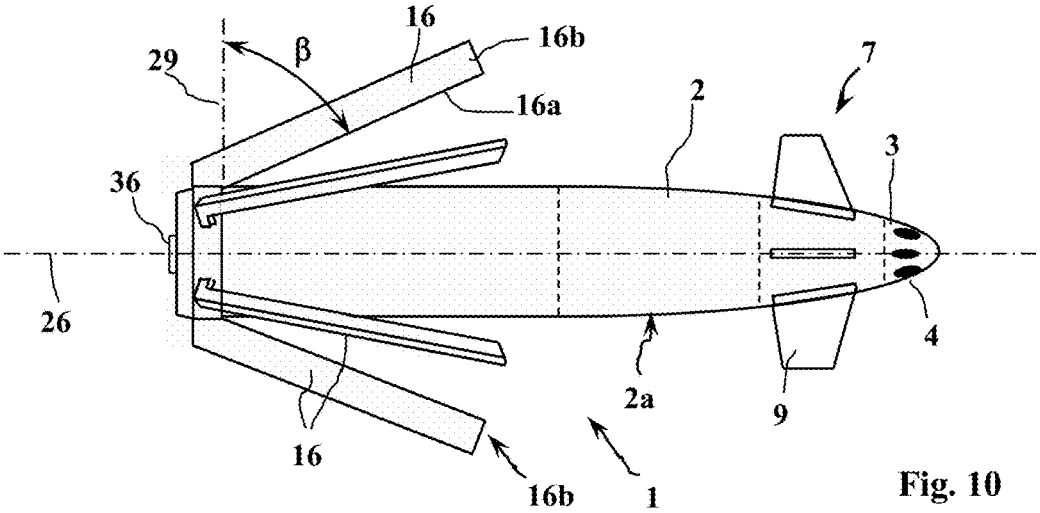
Figure 11:
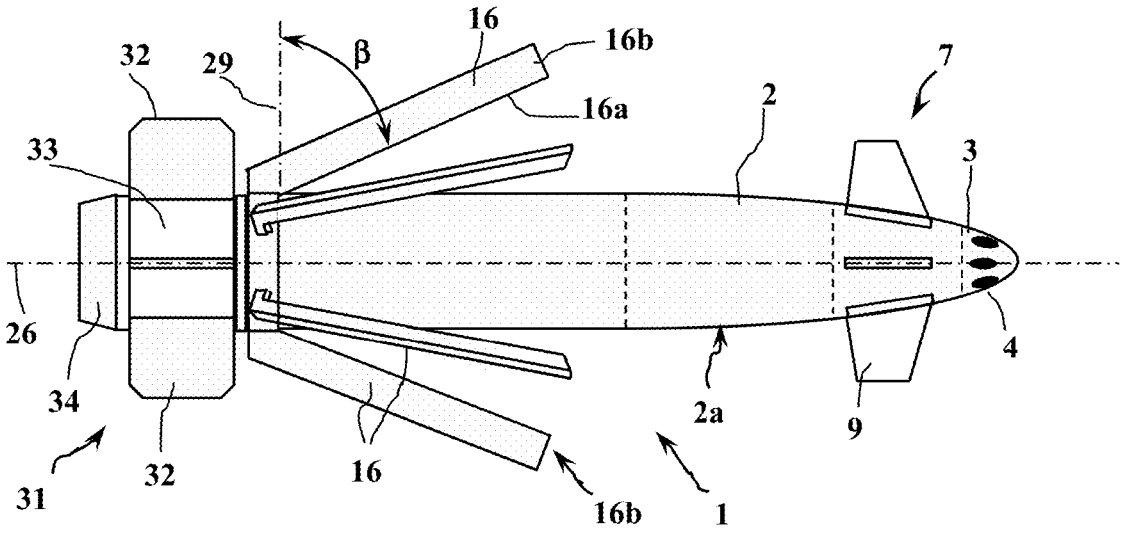

FIG. 5*a* is a partial cross-sectional view of the rear part of this first embodiment, the projectile being shown before the opening of the wings of the wing system;

FIG. 5*b* is a partial cross-sectional view of the rear part of this first embodiment, the projectile being shown with the wings being in the position they occupy during the ballistic phase, hence with the sweepback angles being positive;

FIG. 5*c* is a partial cross-sectional view of the rear part of this first embodiment, the projectile being shown during the beginning of the movement of the maneuvering means;

FIG. 5*d* is a partial cross-sectional view of the rear part of this first embodiment, the projectile being shown during a first intermediary phase of the movement of the maneuvering means;

FIG. 5*e* is a partial cross-sectional view of the rear part of this first embodiment, the projectile being shown during a second intermediary phase of the movement of the maneuvering means;

FIG. 5*f* is a partial cross-sectional view of the rear part of this first embodiment, the projectile being shown with the wings in the locked position they occupy during the piloted phase, hence with the sweepback angles being negative;

FIGS. 6*a* and 6*b* show a wing and its housing in partial perspective and in an insulated manner, FIG. 6*a* showing the wing in its folded position and FIG. 6*b* showing the wing at the beginning of its opening movement;

FIGS. 7*a*, 7*b*, 7*c*, 7*d*, 7*e* and 7*f* show a partial rear perspective of the projectile, FIG. 7*a* showing the wings in folded position and FIG. 7*f* showing the wings in ballistic position, hence with the sweepback angles being positive, the other figures showing intermediary phases of the opening movement of the wings;

FIG. 8 is an external view of a projectile according to a second embodiment of the invention, the projectile being shown before firing;

FIG. 9 is an external and perspective view of this projectile during its ballistic phase;

FIG. 10 is an external and perspective view of this projectile during its piloted phase;

FIG. 11 is an external view of a projectile according to a third embodiment during its piloted phase.

Figure 1:
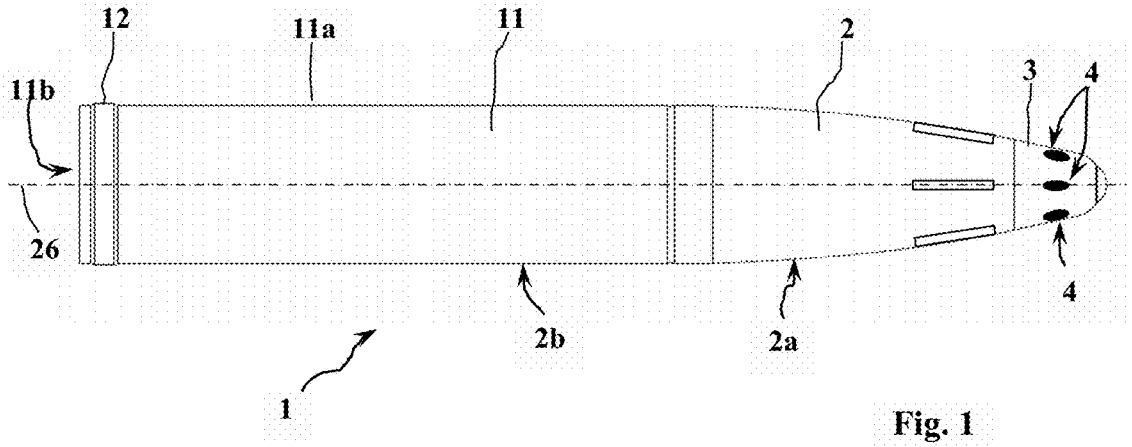
FIG. 1 is an external view of a projectile according to a first embodiment of the invention, the projectile being shown before firing.
Figure 2:
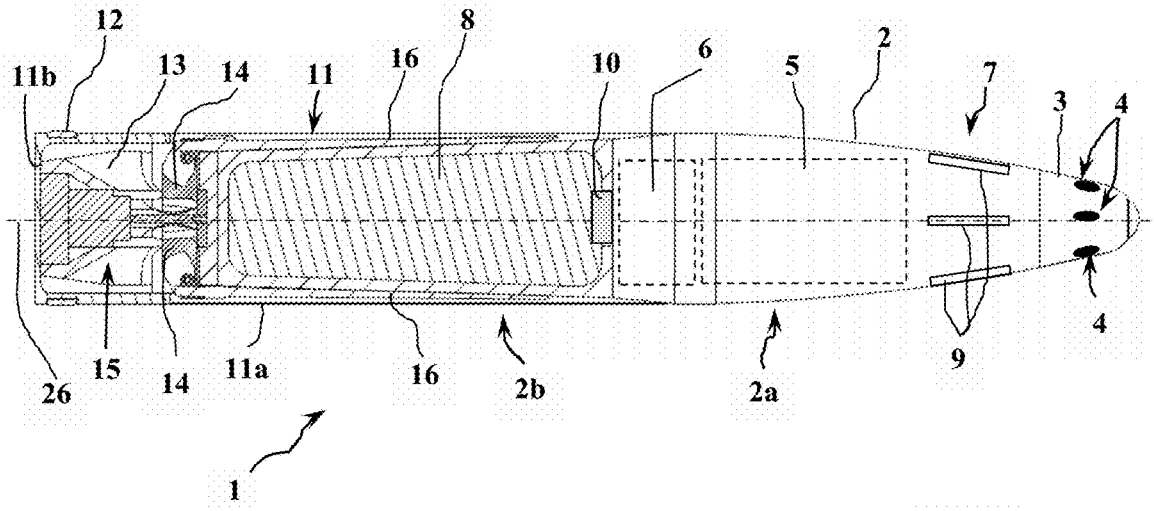
FIG. 2 is a schematic longitudinal sectional view of the projectile according to this first embodiment of the invention.

If referring to FIGS. 1 and 2, an artillery projectile 1 according to a first embodiment of the invention comprises a body 2 carrying a fuze 3 provided with target sensors 4 (for example, infrared sensors) evenly and angularly distributed. A single axial sensor could also be provided, with a field sufficient to detect and track a target. The projectile could have, for example, a caliber of 155 mm.

The body 2 has a front portion 2*a* and a rear portion 2*b*.

The rear portion 2*b* encloses an explosive charge 8 and its priming relay 10.

The front portion 2*a* encloses a guiding/piloting electronics 5 (which could comprise a satellite positioning device or GPS), a safety and arming device 6 for the explosive charge 8, and a piloting means 7 for piloting the projectile. The piloting means 7 here consists in four canard controls 9 which are deployable on the trajectory. The controls 9 will be deployed using a mechanism (not shown) of a known type, for example, that described in patent FR2949848. The deployment of the controls 9 will be controlled at a given time on the trajectory by the guiding/piloting electronics. Motor-reduction units will control the pivoting of the canard controls (or of a plane of canard controls) after deployment in order to allow the piloting.

The rear portion 2*b* of the projectile is covered by a sabot 11 which is a composite or metal part comprising a tubular portion 11*a* closed by a bottom 11*b*. The sabot 11 carries, at its rear portion, a sliding band 12 which is intended to ensure the tightness to propellant gases when firing the projectile in an artillery barrel.

In a conventional manner, described in patent EP905473, the sliding band allows to communicate to the projectile only a part of the rotation induced by the grooves of the weapon barrel. The rotation speed of the projectile when exiting the weapon barrel is thus of the order of a few tenths of revolutions per second (the usual rotation of a shell of 155 mm without sliding band is of the order of 300 revolutions/second).

As more particularly seen in FIG. 2, the projectile 1 carries, at its rear portion, a rear base 13 which carries housings 14 each connected to a wing 16 and a means 15 for maneuvering these wing housings 14.

The projectile further carries an aerodynamic stabilization means which, according to this first embodiment, consists in a wing system comprising at least two wings 16. Here, the projectile 1 has six wings 16 evenly and angularly distributed.

According to the configuration of the ballistic phase shown in FIG. 2, the wings 16 are folded along the projectile 1 with the plane of each wing 16 being applied along an outer wall of the projectile 1, at the rear portion 2*b*.

Thus, the sabot 11 also covers the wings 16 during the inner ballistic phase (in the weapon barrel) and ensures their protection against the effect of the propellant gases and the shocks of the barrel depending on the tossing around of the projectile.

FIG. 5*a* more precisely shows the rear base 13, with the sabot 11 being removed. In this figure, the wings 16 are in the position they occupy before opening. Each wing 16 is applied against an outer wall 17 of the projectile 1. The wall will have a planar profile or a profile corresponding to that of the aerodynamic profile of the wing, thereby allowing the wing 16 to be received.

In this FIG. 5*a*, two wings 16 are visible.

Each wing 16 is connected to a housing 14 with respect to which it is pivotably mounted via a wing support 18.

A pivot 19 allows the support 18 of the wing 16 to tilt with respect to the housing 14.

The wing is further connected to the support 18 by a rod 20 comprising means allowing it to pivot with respect to the wing support 18 during the tilting movement of the support 18 with respect to the housing 14.

Such an architecture allowing the wing to pivot around its rod 20 during the opening of the wing is described in detail by patent EP1524488 to which reference can be made for more details.

If referring more particularly to FIGS. 6*a* and 6*b*, a wing 16 can be seen insulated and attached to its housing 14 by the support 18. It can be noted that the housing 14 has lateral trunnions 14*a* and 14*b* which will allow the housing 14 to be pivotably mounted with respect to the rear base 13. These trunnions will be accommodated in bearings of the base (not shown).

The means allowing the rod 20 to pivot with respect to the support 18 particularly comprise a lateral arm 21 integral with the end of the rod 20 (arm visible in FIGS. 6*a* and 6*b* and also FIG. 5*b*). The arm cooperates with a cam profile 22 carried by the housing 14 (FIGS. 5*a* and 6*a*).

Thus, during the opening of the wing 16 by the effect of the received aerodynamic loads and of the offset between the point of application of the aerodynamic force and the pivot 19, the support 18 tilts with respect to the housing 14 on its pivot 19 (the geometrical axis of the pivot 19 is identified in FIGS. 6*a* and 6*b*). When tilting, the arm 21 will be driven by the cam profile 22 and cause the wing 16 to pivot with respect to its support 18. The plane of the wing 16 will pivot by 90° and be positioned in the direction of the aerodynamic flow (FIG. 5*b*).

FIGS. 7*a*-7*f* allow to see different steps of the pivoting of the wing 16. FIG. 7*a* shows (as in FIG. 5*a*) the different wings positioned along the outer wall 17 of the projectile.

FIG. 7*b* shows the beginning of the opening of the wings 16. The pivoting of the supports 18 applies the arms 21 of each wing against the cam profile 22.

Each wing then pivots with respect to its support 18 along the axis of its rod 20. FIGS. 7*c* and 7*d* show two steps for such pivoting of the wing.

FIG. 7*e* shows the wing at the end of its pivoting. It then has its plane in the direction of the aerodynamic flow, and the trailing edge of the wing 16 is oriented towards a radial slot 24 provided in the base 13.

When the wing 16 is pivoted, it is locked with respect to its support 18, for example by bracing of a spring blade (not shown), perpendicular to the plane of the wing 16, and integral with the housing 14 (such a solution is described in patent EP1798513).

Figure 3:
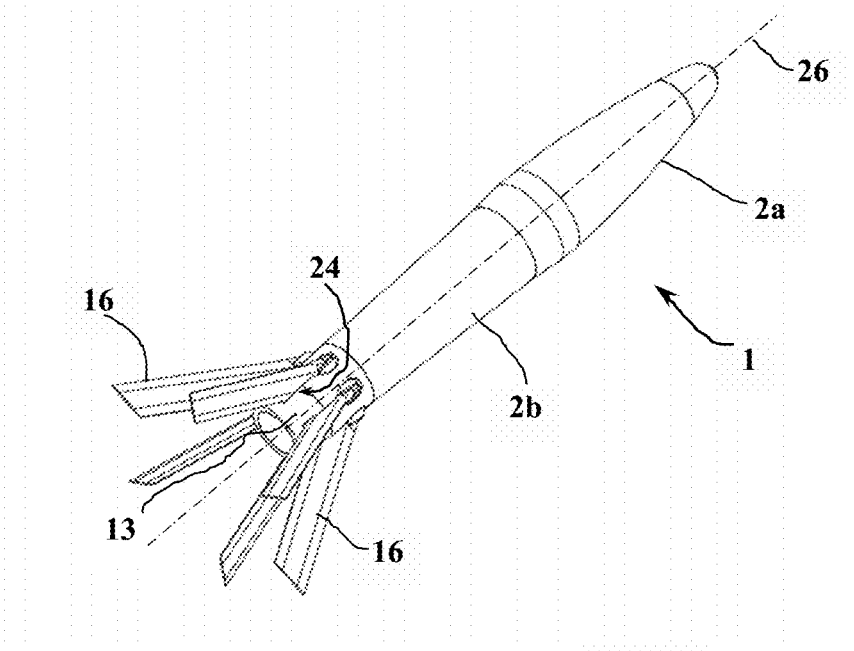
FIG. 3 is an external and perspective view of the projectile according to the first embodiment during its ballistic phase.
Figure 4:
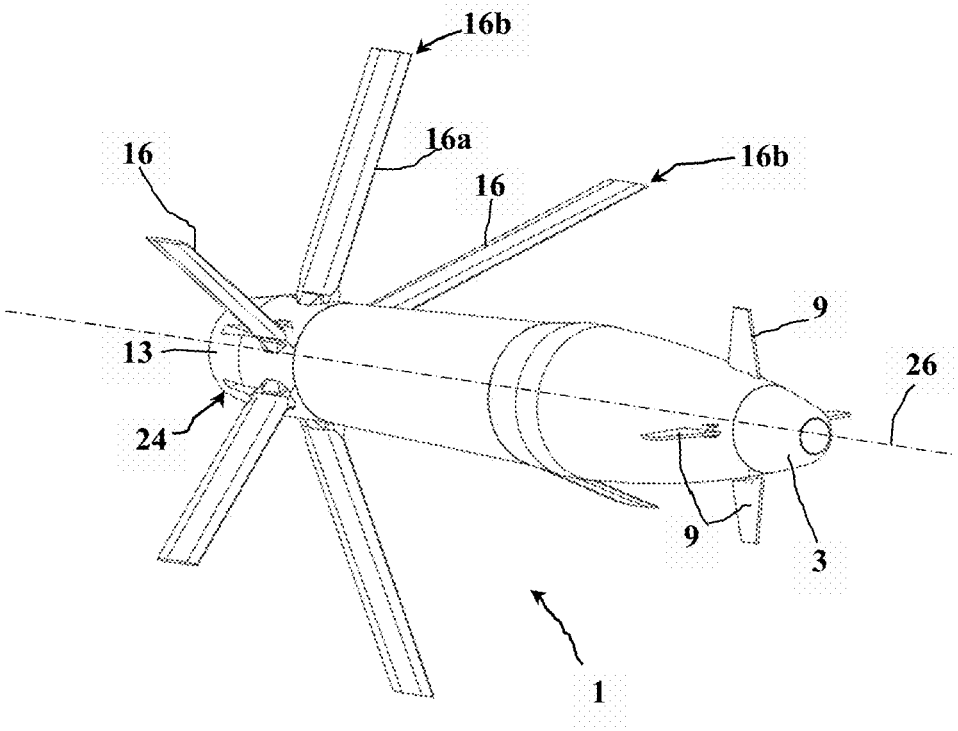
FIG. 4 is an external and perspective view of the projectile according to the first embodiment during its piloted phase.

FIGS. 5*b* and 7*f* show the rear portion of the projectile when the wings 16 are in the position they occupy during the ballistic phase. It can be seen that, in this position, the wings 16 abut against a rear seating 23 of the base 13. Each wing is accommodated in a radial slot 24 of the rear seating 13. FIGS. 3 and 4 allow to see the rear base 13 with its radial slots 24.

Furthermore, the different housings 14 carrying the wings 16 are pivotably mounted with respect to the rear base 13 by using the trunnions 14*a*, 14*b*.

As can be seen in FIG. 5*a*, the rear base 13 encloses a maneuvering means 15 which allows to pivot all the housings 14 carrying the wings 16 so as to change simultaneously the sweepback angle of all the wings 16.

The maneuvering means 15 comprises a piston 25 having the same axis as the axis 26 of the projectile. This piston 25 has a rear face which bears against a lower face 14*a* of the housings 14. The maneuvering means 15 also has a motor means which can translate the piston 25 via a rod 28 (for example, by a worm screw connection).

As the piston 25 is simultaneously in contact with all the housings 14, the translation of the piston 25 causes all the housings 14, thus all the wings 16, to pivot simultaneously.

Thus, FIG. 5*b* shows the rear portion of the projectile 1 when the wings 16 are in their deployed position with a positive sweepback angle $\alpha$. The sweepback angle is the angle between the leading edge 16*a* of the wing 16 and a plane 29 perpendicular to the axis 26 of the projectile.

The positive sweepback angle $\alpha$ is around 60°. FIG. 3 shows the projectile 1 in this flight configuration which is that corresponding to the ballistic phase.

When controlling the motor means 27, the piston 25 causes all the housings 14 to pivot simultaneously. FIG. 5*c* thus shows the beginning of the translation movement of the piston 25, thus of the pivoting of the housings 14 and the associated wings 16.

FIG. 5*d* shows a first intermediary phase of the translation movement of the piston 25, phase during which the sweepback angles of the wings 16 are zero (wings 16 perpendicular to the axis 26 of the projectile).

FIG. 5*e* shows a second intermediary phase of the translation movement of the piston 25. This phase corresponds to a position of the wings 16 with a sweepback angle $\beta$ which is negative, that is, with the free ends 16*b* (see FIG. 4) of the wings 16 being all oriented towards the front of the projectile 1.

Each wing 16 is then engaged in a notch 30 of the projectile body 1. The notches 30 allow to block the root of each wing 16. The value of the sweepback angle $\beta$ is approximatively −30°.

Finally, FIG. 5*f* shows the final position of the piston 25. The sweepback angle of the wings 16 has not been changed between FIG. 5*e* and FIG. 5*f*, but the piston 25 has continued its stroke and is in a final position at the end of the translation, in which it ensures a blockage of all the housings 14 in the position with a negative sweepback angle $\beta$.

To ensure this blockage, the cylindrical peripheral edge of the piston 25 cooperates with the lower face 14*a* of each housing 14. The piston 25 is, in the final position, arranged at a distance D from the pivot axis of each housing 14 and prevents the wings from returning in a position with a positive sweepback angle.

The rigidity of the final position is ensured, each fin being engaged in a notch 30 and blocked by the piston 25.

The operation of the projectile according to the invention is the following.

When firing the projectile, the sliding band 12 allows to limit the rotation speed of the projectile to a few tenths of revolutions per second (while the rotation speed of a projectile of 155 mm is higher than 300 revolutions per second for long range firings).

The sabot 11 which ensures both the acceleration of the projectile 1 and the tightness to propellant gases separates naturally from the projectile 1 when exiting the weapon barrel, by the action of the aerodynamic forces.

As an alternative, an assistance to the separation could be performed, for example, by a propellant gas action or a spring mechanism arranged between the base 13 and the sabot 11. Patent EP905473 describes such modes of separation by gas action.

Once the sabot 11 is ejected, the wings 16 deploy naturally under the action of the centrifugation of the wings and of the dynamics of the projectile when exiting the barrel.

When each wing 16 rises against the flow by an aerodynamic effect, it immediately pivots with respect to its housing 14 with its wing support 18 limiting the tilting speed of the wing, and thus the impact at the end of the opening. A heavy wing indeed limits the impact intensity by inertia effect. The mechanism formed by the rod 20 and its arm 21 cooperating with the profiles 22 provided on the housing 14 causes the wing 16 to pivot and to be positioned in the wind's path, wherein the plane of the wing 16 is radial with respect to the projectile and thus passes through the axis 26 of the projectile.

The wings all assume the position shown in FIGS. 3 and 5*b*, position in which they are rearwardly abutting against the rear seatings 23 of the radial slots 24. Each wing 16 is further locked with respect to its housing 14 by a suitable blocking device, for example the one described by patent EP1798513 (blockage by bracing of a spring blade).

The positive sweepback angle of about 60° minimizes the drag in supersonic flight while ensuring a sufficient static margin (of the order of −1 caliber), thereby guaranteeing the stability of the projectile when exiting the barrel, during the most critical flight phase (high-Mach supersonic flight). When the speed decreases, the static margin increases.

Once the wings 16 are deployed, the projectile 1 is in its ballistic flight phase. It can climb at an altitude higher than 1000 m with significant propelling charges and a minimum aerodynamic drag configuration. Besides, the wings 16 reduce the rotation speed of the projectile 1.

After a period of time, for example, programmed at a computer of the guiding electronics 5 or programmed in a specific electronic module accommodated within the base, the maneuvering means 15 is controlled for changing the sweepback angle of the wings 16. This control preferably occurs at the peak of the trajectory, when the projectile initiates its descent to reach the highest ranges.

The maneuvering means 15 allows to tilt the wings 16 towards the front of the projectile 1. The angular amplitude of the tilting is of the order of 90° (the wings switching from +60° to −30°).

The motor means 27 of the maneuvering means 15 could be electrical or pyrotechnic (retractor, lock, cylinder . . . ). The tilting could be performed within a few seconds, as the stability of the projectile during this transitional phase will always be ensured (subsonic flight).

Furthermore, the power required to this maneuvering is reduced due to the low air density and the minimum drag of the wings.

When the wings 16 have their free end 16*b* oriented towards the front of the projectile (negative sweepback angle), the canard controls 9 are also deployed and operational (FIG. 4). The change of the sweepback angle of the wings 16 was controlled at the vicinity of the peak of the trajectory of the projectile 1.

Due to the negative sweepback angle of the wings, the aerodynamic stability of the projectile 1 is reduced (static margin lower than −0.5 caliber).

The optimum value to be selected for the static margin depends on the performances of the projectile flight control chain and the flight goals.

With the invention, it is possible to adjust the static margin to the profile of the mission considered. For very-long range firing, strong emphasis will be put on the maneuverability in terminal phase. For short range firing, it will be possible to hold the wings in ballistic position (positive sweepback angle position), and not to control their switch to the front position (negative sweepback angle). The maneuverability will thus be reduced with a projectile which has a very high static stability, but this can be acceptable for a short range firing.

The static margin with a negative sweepback position is selected to be just sufficient to ensure the aerostabilization of the projectile, whether the canards 9 are deployed or not.

The canard controls 9 will allow to pilot the projectile by changing its incidence. The wings 16 with a negative sweepback angle ensure a high lift and will allow a high maneuverability due to their good aerodynamic lift characteristics.

The projectile according to the invention thus allows to ensure both the stability in supersonic ballistic flight and the capacities of important maneuvers in terminal piloting phase in subsonic flight.

FIGS. 8 to 10 show a projectile according to a second embodiment of the invention.

This embodiment is here shown in a very schematic manner.

As in the previous embodiment, the projectile 1 comprises a body 2 carrying a fuze 3 provided with target sensors 4 (for example, infrared sensors) evenly and angularly distributed, or comprising a single axial sensor with a field sufficient to detect and follow a target. The guiding/piloting electronics could also have a satellite positioning device or GPS. The body 2 has a front portion 2*a* and a rear portion 2*b*.

The rear portion 2*b* encloses an explosive charge and its priming relay (not visible in the figures) and the front portion 2*a* encloses a guiding/piloting electronics, a safing and arming device for the explosive charge, and a piloting means 7 for piloting the projectile.

The piloting means 7 here consists in four canard controls 9 which are deployable on the trajectory.

The rear portion 2*b* of the projectile is partially covered by a sabot 11 which is a composite or metal part comprising a tubular portion 11*a* closed by a bottom 11*b*. The sabot 11 carries, at its rear portion, a sliding band 12 which is intended to ensure the tightness to propellant gases when firing the projectile in an artillery barrel.

This projectile 1 differs from the one described above in that the aerodynamic stabilization means comprises:

- on one hand, a wing system formed by wings 16 which are during the ballistic phase in folded position, arranged with the plane of each wing 16 being applied along an outer wall of the projectile 1, at the rear portion 2*b;*
- on the other hand, a folding tail assembly 31 which is arranged at a base 34 integral with the rear portion 2*b* of the projectile, rearwardly of the wing system 16.

The tail assembly 31 here consists in fins 32 constituted by steel plates which are, for example, embedded or hinged at their root to the base 34 and lockable in deployed position.

These fins 32 are at the beginning elastically winded on a cylindrical portion 33 of the base 34 and held in position by the sabot 11.

The sabot 11 could be ejected after firing, either by the effect of propellant gas action within the barrel, or by the effect of aerodynamic flow applied thereto when exiting the barrel. The sabot could, for example, carry longitudinal weakened portions causing a cutout in a petal shape when exiting the weapon barrel and the sabot is ejected.

The ejection of the sabot 11 when exiting the weapon barrel causes the deployment of the fins 32 which ensure the stabilization of the projectile during its entire ballistic phase, as well as its rotation braking.

Contrary to the previous embodiment, during this ballistic phase, the wings 16 of the wing system remain in folded position (FIG. 9).

The wings 16 are held in folded position, for example, by locks 35 which are integral with the body 2 of the projectile and which engage in holes in the ends of the wings 16.

Furthermore, the base 34 is made integral with the rear portion 2*b* of the projectile body by a pyrotechnic bolt 36.

At the vicinity of the peak of the trajectory, after a period of time which, for example, will be programmed at a computer of the guiding electronics, the pyrotechnic bolt 36 is controlled for causing the separation of the base 34 and the body 2 of the projectile. Furthermore, the locks 35 are controlled so as to release the wings 16.

Each wing 16 is connected to the body 2 of the projectile by a connection of the type described above with reference to FIG. 5*a* and also described by patent EP1524488.

This connection is not drawn in detail. It comprises, as previously described, a housing integral with the body 2 and with respect to which pivots a wing support receiving a rod integral with the wing, which itself can rotate with respect to the support and carries a lateral arm cooperating with a cam profile of the housing.

This connection allows the wing to pivot around its rod when opening the wing, thereby allowing to switch from a position in which the plane of the wing bears against the projectile body (FIG. 9) to a position in which the plane of the wing 16 has pivoted by 90° and is positioned in the direction of the aerodynamic flow (FIG. 10), the wing 16 having its leading edge 16*a* in the aerodynamic flow.

The cam profiles of the housing will be sized by the one skilled in the art so as to ensure a rotation of the wing with a final position such as shown in FIG. 10, with a negative sweepback angle β, that is, with the free ends 16*b* of the wings being oriented towards the front of the projectile. A rear stop will be positioned so as to ensure that the wings keep this negative sweepback angle.

Meanwhile, the canard controls 9 are deployed and operational.

Due to the negative sweepback angle of the wings 16, the aerodynamic stability of the projectile 1 is reduced (static margin lower than −0.5 caliber). This margin is selected to be just sufficient to ensure the aerostabilization of the projectile, whether the canard controls 9 are deployed or not.

This embodiment allows to eliminate the transition phase of the wings 16 from a positive sweepback angle to a negative sweepback.

The means ensuring the stabilization in ballistic phase and in piloted phase are then distinct and the movement for deploying the wings 16 has also a reduced amplitude.

Various alternatives of this embodiment are possible.

For example, the fins 32 could be connected to the base 34 by longitudinal grooves which will open onto the rear of the base. Each fin 32 will then be designed to slide axially in the corresponding groove.

A stop will be provided at the rear portion of the base 34. Moving aside the stop will allow the fins 32 to be axially ejected by sliding in the corresponding groove under the effect of the aerodynamic resistance.

This ejection of the fins could then occur without requiring that the entire base 34 be ejected. Such an alternative allows to preserve substantially the same length for the projectile 1 during the ballistic and piloted phases.

As an alternative, in this last embodiment, wings 16 the plane of which remains positioned radially to the projectile and which pivot each around an axis perpendicular to the axis 26 of the projectile could be implemented. This embodiment requires, however, to have radial grooves in the body 2 of the projectile 1 and wings 16 which then enters into the body 2. The capacities of the projectile to carry explosives will then be reduced.

FIG. 11 shows another embodiment of the projectile according to the invention which differs from the previous embodiment in that the tail assembly 31 is not ejected at the vicinity of the peak of the trajectory.

FIG. 11 shows the projectile during its piloted flight phase. The canard controls 9 are deployed as well as the wings 16 which have a negative sweepback angle. The rear fins 32 are still constituted by steel plates embedded or hinged to the base 34. They remain integral with the projectile during this piloted phase. This embodiment increases a little the aerodynamic drag of the projectile, but could be satisfactory in some configurations.

The invention claimed is:

1. An artillery projectile configured to have a trajectory with a ballistic phase and a piloted phase, the projectile comprising:

at least one aerodynamic stabilization means ensuring aerodynamic stabilization of the projectile on part or all of the trajectory of the projectile; and a means configured to ensure a piloting during the piloted phase, wherein the aerodynamic stabilization means comprises a wing system having at least two wings which are positioned with respect to an axis of the projectile, at least during the piloted phase, the at least two wings having sweepback angles that are negative, that is, free ends of the wings are oriented towards a front of the projectile;

wherein the wings of the wing system deploy during a first part of the ballistic trajectory to have positive sweepback angles, a maneuvering means is provided for allowing to change the sweepback angle of the wings and to make the sweepback angle have negative values during a second part of the ballistic trajectory; and wherein each wing is connected to a housing with respect to which the wing is mounted in a tilting manner via a wing support, the wing is connected to the support by a rod having means allowing the rod to pivot with respect to the wing support during a tilting movement of the support with respect to the housing, the wing thus switching from a folded position, in which the wing is positioned along the projectile with a plane of the wing applied along an outer wall of the projectile, to a deployed position in which the plane of the wing is radially oriented with respect to the projectile, each housing is further pivotably mounted with respect to a body of the projectile and the maneuvering means allowing to pivot all the housings carrying the wings to change simultaneously the sweepback angle of all the wings.

2. The artillery projectile according to claim 1, wherein the maneuvering means has a piston having a same axis as the axis of the projectile, the piston comprising a rear face which bears against a lower face of the housings, the piston is able to translate by the action of a motor, the translation of the piston causing all the housings to pivot simultaneously.

3. The artillery projectile according to claim 2, wherein the piston assumes a final position at upon completion of the translation, in which the piston ensures a blockage of all the housings in the position with a negative sweepback angle.

4. The artillery projectile according to claim 1, wherein the housings of the wings and the maneuvering means are accommodated within a rear base integral with the projectile body.

5. The artillery projectile according to claim 4, wherein the projectile comprises a sabot surrounding the base and covering the wings in their folded position, the sabot carrying a sliding band and is ejected after firing.

6. The artillery projectile according to claim 1, wherein each wing is engaged in a notch of the projectile body when each wing is in a final position with a negative sweepback angle.

7. The artillery projectile according to claim 1, wherein the aerodynamic stabilization means also has a folding tail assembly which is arranged at a rear portion of the projectile, and the tail assembly is deployed during the ballistic phase.

8. The artillery projectile according to claim 7, wherein the tail assembly is attached to the projectile by a releasable connecting means, and the tail assembly is ejected before opening the wing system with negative sweepback angles.

* * * * *